US007819062B2

(12) United States Patent
Greywall

(10) Patent No.: US 7,819,062 B2
(45) Date of Patent: Oct. 26, 2010

(54) SAFETY AND ARMING DEVICE FOR HIGH-G MUNITIONS

(75) Inventor: Dennis S. Greywall, White House Station, NJ (US)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 654 days.

(21) Appl. No.: 11/778,949

(22) Filed: Jul. 17, 2007

(65) Prior Publication Data

US 2010/0212528 A1 Aug. 26, 2010

(51) Int. Cl.
*F42C 15/24* (2006.01)

(52) U.S. Cl. ..... 102/247; 102/222; 102/229; 102/231; 102/235; 102/249; 102/251; 102/254; 102/256

(58) Field of Classification Search ..... 102/249, 102/231, 222, 235, 254, 251, 247, 256, 226, 102/229
See application file for complete search history.

(56) References Cited

U.S. PATENT DOCUMENTS

| | | | | |
|---|---|---|---|---|
| 3,812,783 | A | 5/1974 | Yang et al. | |
| 4,694,752 | A | 9/1987 | Titus | |
| 5,052,300 | A | 10/1991 | Josse | |
| 5,204,490 | A | 4/1993 | Soltz et al. | |
| 5,229,542 | A | 7/1993 | Bryan et al. | |
| 6,167,809 | B1 | 1/2001 | Robinson et al. | |
| 6,314,887 | B1 * | 11/2001 | Robinson | 102/262 |
| 6,321,654 | B1 | 11/2001 | Robinson | |
| 6,964,231 | B1 * | 11/2005 | Robinson et al. | 102/235 |
| 7,051,656 | B1 * | 5/2006 | Koehler et al. | 102/249 |
| 7,142,087 | B2 | 11/2006 | Greywall | |
| 7,218,193 | B2 | 5/2007 | Greywall | |
| 7,383,774 | B1 * | 6/2008 | Koehler et al. | 102/249 |
| 2005/0183609 | A1 * | 8/2005 | Greywall | 102/247 |

FOREIGN PATENT DOCUMENTS

| | | |
|---|---|---|
| EP | 0 807 841 A2 | 11/1997 |
| FR | 2 760 266 A1 | 9/1998 |

OTHER PUBLICATIONS

"Monolithic MEMS optical switch with amplified out-of-plane angular motion", by Lopez, D. et al., published in "Optical MEMs, 2002. Conference Digest. 2002 IEEE/LEOS International Conference on Aug. 20-23, 2002, pp. 165-166" on "Aug. 23, 2002". cited by other.

* cited by examiner

*Primary Examiner*—Michael Carone
*Assistant Examiner*—Jonathan C Weber
(74) *Attorney, Agent, or Firm*—Mendelsohn, Drucker & Associates, P.C

(57) ABSTRACT

A representative embodiment of the invention provides a MEMS-based safety and arming (S&A) device having a shuttle movably connected to a frame by one or more bowed springs. The device has an electrical path adapted to electrically connect the frame and a contact pad. In the initial state, the electrical path has an electrical break. If the inertial force acting upon the shuttle (e.g., during launch) reaches or exceeds a first threshold value, then displacement of the shuttle with respect to the frame causes the electrical break to close. If the inertial force reaches or exceeds a second threshold value greater than the first threshold value, then a latching mechanism employed in the S&A device latches to keep the electrical break irreversibly closed thereafter.

21 Claims, 5 Drawing Sheets

500

SAFETY AND ARMING DEVICE FOR HIGH-G MUNITIONS

GOVERNMENT CONTRACT

This invention was made with Government support under Contract No. DAAE30-03-D-1013-10 awarded by the Picatinny Arsenal. The Government has certain rights in this invention.

BACKGROUND OF THE INVENTION

1. Field of the Invention

The present invention relates to micro-electromechanical systems (MEMS) and, more specifically, to MEMS-based safety and arming devices.

2. Description of the Related Art

An artillery shell is typically equipped with a safety and arming (S&A) device that permits detonation of the explosive charge only after the projectile has experienced a valid progression of physical launch conditions, including the large initial acceleration in the gun barrel. The S&A device functions with sequential interlocks to remove a barrier in the fire train and/or to move out-of-line fire-train components into alignment. Once armed, the device permits initiation of the explosive, e.g., with an electrical discharge or a laser pulse, which initiation eventually causes the explosive to detonate.

U.S. Pat. No. 6,167,809, which is incorporated herein by reference in its entirety, discloses a mechanical S&A device that is assembled using several separately manufactured components, such as screws, pins, balls, springs, and other elements machined with relatively tight tolerance. One problem with that device is that it is relatively large (e.g., several centimeters) in size and relatively expensive to manufacture and assemble. Each of U.S. Pat. Nos. 7,142,087 and 7,218,193, both of which are also incorporated herein by reference in their entirety, discloses a MEMS-based S&A device formed using a silicon wafer. While the latter devices are advantageously relatively small (e.g., about 1 mm) in size and relatively inexpensive to manufacture, they are not specifically designed for withstanding very hard launches, e.g., those causing initial accelerations of over 50,000 g.

SUMMARY OF THE INVENTION

A representative embodiment of the invention provides a MEMS-based safety and arming (S&A) device having a shuttle movably connected to a frame by one or more bowed springs. The device has an electrical path adapted to electrically connect the frame and a contact pad. In the initial state, the electrical path has an electrical break. If the inertial force acting upon the shuttle (e.g., during launch) reaches or exceeds a first threshold value, then displacement of the shuttle with respect to the frame causes the electrical break to close. If the inertial force reaches or exceeds a second threshold value greater than the first threshold value, then a latching mechanism employed in the S&A device latches to keep the electrical break irreversibly closed thereafter.

A bowed spring of the S&A device is a nonlinear spring that can perform a function analogous to that of a mechanical stop. However, unlike a mechanical stop, the bowed spring is able to stop the shuttle gradually and without imparting on the shuttle a "hard" physical contact with an external structure. As a result, occurrence of damaging shock waves, e.g., caused by such hard physical contacts, is advantageously reduced, which enables S&A devices of the invention to function properly at accelerations as high as about 80,000 g.

According to one embodiment, a device of the invention comprises: (i) a frame; (ii) a contact pad mechanically attached to the frame; and (iii) a first shuttle movably connected to the frame by one or more springs. The one or more springs include a first bowed spring. The first shuttle is adapted to move with respect to the frame in response to an inertial force. The device is adapted to electrically connect the frame and the contact pad. If a projection of the inertial force onto a designated axis is smaller than a first threshold value, then the frame and the contact pad are not electrically connected. If the projection reaches or exceeds the first threshold value, then displacement of the first shuttle produced by the inertial force causes the contact pad to be electrically connected to the frame.

BRIEF DESCRIPTION OF THE DRAWINGS

Other aspects, features, and benefits of the present invention will become more fully apparent from the following detailed description, the appended claims, and the accompanying drawings in which:

DETAILED DESCRIPTION

Figure 1A:
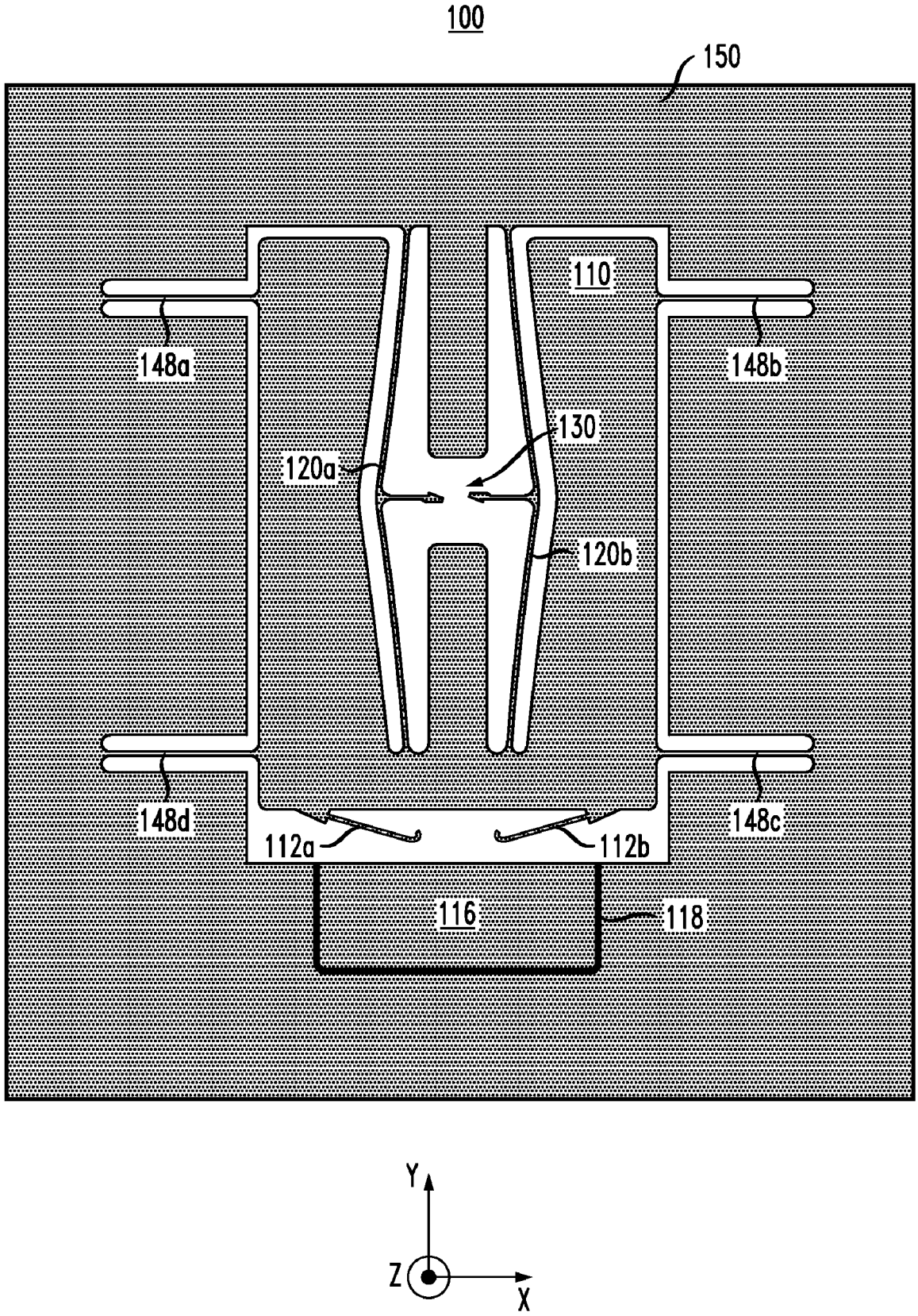
FIGS. 1A-B show a safety and arming (S&A) device according to one embodiment of the invention.

One representative MEMS-based safety and arming (S&A) device has a shuttle movably connected to a frame by one or more linear springs. As used herein, the term "linear spring" means that the spring force is substantially proportional to the spring deformation (e.g., expressed in terms of displacement relative to an undeformed state) over at least a significant portion of the operating range of the spring. The S&A device becomes armed, e.g., when the shuttle displacement causes an electrical switch controlling the fire train to close. The springs provide a potential-energy barrier against accidental arming due to mishandling of the artillery shell, such as an accidental drop from a truck bed. However, if the S&A device is subjected to acceleration that exceeds the arming threshold, then the resulting inertial force causes the shuttle to overcome the potential-energy barrier and close the switch.

The S&A device typically employs a latching mechanism designed to keep the switch closed after the acceleration falls below the arming threshold, e.g., during free flight of the projectile. The latching mechanism is characterized by $a_{latch}$, the acceleration at which the latching mechanism becomes fully engaged. The value of $a_{latch}$ is typically smaller than $a_{max}$, the maximum acceleration that the S&A device will experience during launch. As the acceleration grows beyond $a_{latch}$, the linear springs continue to deform, thereby attempting to move the shuttle out of the latching position. To limit this unwanted movement, the S&A device typically employs a mechanical stop. When the acceleration achieves $a_{latch}$, the shuttle comes into physical contact with the mechanical stop, which curbs further displacement of the shuttle.

During a hard launch, the initial acceleration may achieve $a_{latch}$ very quickly, which may impart on the shuttle a relatively high velocity with respect to the mechanical stop. As a result, the physical contact between the shuttle and the mechanical stop can be relatively hard, e.g., can resemble an impact rather than a touch. A shock wave caused by such an impact might damage the shuttle, the latching mechanism, and/or the switch, thereby disadvantageously causing the S&A device to malfunction.

The above-described problems are addressed by various embodiments of an S&A device having a shuttle movably connected to a frame by one or more bowed springs. As used herein, the term "bowed spring" means that the spring has one or more of the following attributes: (1) the spring comprises a beam whose shape, in the undeformed state (defined as the state in which the material of the beam is substantially free of strains or stresses, except those that might be induced by the force of gravity), deviates from that of a straight beam; (2) a tension force applied in the longitudinal direction (i.e., along the length of the beam) tends to straighten the beam; (3) the spring is a nonlinear spring, meaning that the longitudinal end-point displacement is not proportional to the applied force over at least a significant portion of the operating range of the spring and tends toward a limiting value with increasing force; (4) the transverse (i.e., perpendicular to the length of the beam) displacement near the center point of the beam is larger than the longitudinal displacement near the end point of the beam; and (5) a midpoint transverse force required to make the beam straighter by a prescribed amount is smaller than the longitudinal force required to make the beam straighter by the same amount. The use of bowed springs enables an S&A device of the invention to operate without a mechanical stop. As a result, occurrence of damaging shock waves is advantageously reduced, which enables the S&A device to function properly at accelerations as high as about 80,000 g or even higher.

Figure 1B:
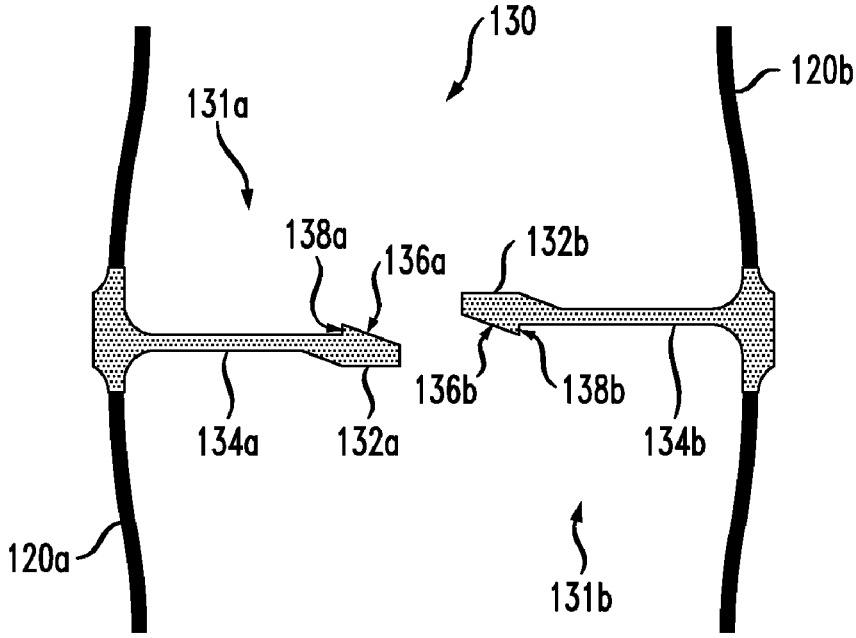

FIGS. 1A-B show an S&A device 100 according to one embodiment of the invention. More specifically, FIG. 1A shows a top view of device 100, and FIG. 1B shows an enlarged view of a latching mechanism 130 employed therein. Device 100 has a shuttle 110 movably connected to a frame 150 by six springs. Of those six springs, four springs 148*a-d* are conventional linear springs, each having the shape of a straight beam. Each of the remaining two springs, i.e., springs 120*a-b*, is a bowed spring.

Springs 148*a-d* are relatively stiff with respect to deformations along the X axis due to their orientation and the straight-beam shape. As a result, displacements of shuttle 110 along the X axis are relatively small during launch. The thickness (i.e., the size along the Z axis) of springs 148*a-d* controls the stiffness of those springs along the Z axis. In a representative embodiment, the thickness of springs 148*a-d* is chosen so that, during launch, displacements of shuttle 110 along the Z axis are relatively small as well. These characteristics of springs 148*a-d* help to keep contact springs 112*a-b* that are attached to an edge of shuttle 110 in good alignment with a contact pad 116. The width (i.e., the size along the Y axis) of springs 148*a-d* is chosen so that the spring force along the Y axis generated by those springs during launch does not contribute more than several percent (e.g., about 5%) into the total spring force acting along that axis, with the total spring force having contributions from bowed springs 120*a-b* and linear springs 148*a-d* and, also, from contact springs 112*a-b* after the latter springs have been pushed against pad 116.

Bowed springs 120*a-b* are designed to generate most (e.g., at least 95%) of the spring force acting upon shuttle 110 along the Y axis. S&A device 100 is oriented in the respective artillery shell so that the Y axis is aligned with the launch direction, e.g., is parallel to the center axis of the gun barrel. When the artillery shell undergoes the initial acceleration in the gun barrel, the inertial force pulls shuttle 110 in the negative Y direction toward pad 116, thereby attempting to straighten bowed springs 120*a-b*. When the acceleration reaches a first threshold value ($a_{contact}$), springs 120*a-b* straighten enough to permit contact of springs 112*a-b* with pad 116. When the acceleration reaches a second threshold value ($a_{latch}$, where $a_{contact}<a_{latch}$), latching mechanism 130 latches, as described in more detail below in reference to FIG. 1B. Latching mechanism 130 remains latched thereafter as S&A device 100 progresses through the subsequent acceleration stages, during which the acceleration first increases up to $a_{max}$ (e.g., near the midpoint of the gun barrel) and then falls to about one g (e.g., during free flight).

One skilled in the art will understand that the inertial force acting upon shuttle 110 equals the acceleration of S&A device 100 multiplied by the shuttle mass m. Therefore, the above-specified contact and latching conditions for S&A device 100 can equally be expressed in terms of the inertial force. For example, the first (contact) threshold can be expressed in terms of $F_{contact}=ma_{contact}$, where $F_{contact}$ is the inertial force corresponding to acceleration $a_{contact}$. The second (latching) threshold can similarly be expressed in terms of $F_{latch}=ma_{latch}$.

In a representative embodiment, undeformed shapes of bowed springs 120*a-b* are described by Eq. (1) as follows:

$$|x| \approx \frac{|x_{mp0}|}{2}[1+\cos(2\pi y/l] \tag{1}$$

where y is the coordinate along the axis that connects the ends of the spring (hereafter the y axis); x is the coordinate along the axis that is orthogonal to the y axis and passes through the midpoint of the spring (hereafter the x or transverse axis); l is the distance between the opposite ends of the spring; and $x_{mp0}$ is the x coordinate of the center point of the undeformed spring. The relationship between the inertial force ($F_y$) and the x coordinate ($x_{mp}$) of the center point of the spring is then given by Eq. (2):

$$1-\left|\frac{x_{mp}}{x_{mp0}}\right| = \left(1+\frac{32E}{\pi^2}\frac{1}{F_y}\frac{w^3 t}{l^2}\right)^{-1} \tag{2}$$

where E is the Young's modulus; w is the width of the spring; and t is the thickness of the spring.

In one embodiment, the parameters of a bowed spring 120 described by Eqs. (1)-(2), such as the spring's material, length, width, and thickness, can be selected so that the spring meets all of the above-specified five attributes of a "bowed spring." For example, analysis of Eq. (2) reveals that spring 120 is a nonlinear spring because, to obtain $x_{mp}=0$ (i.e., to straighten the spring), an infinite inertial force ($F_y \rightarrow \infty$) is required. Thus, spring 120 can perform the function analogous to that of a mechanical stop. However, unlike a conventional mechanical stop, spring 120 is able to stop shuttle 110 gradually because the spring force increases gradually with acceleration. Consequently, S&A device 100 does not need (and does not have) a mechanical stop, which prevents the shock waves that could have been caused by "hard" contacts between the shuttle and a mechanical stop and their potentially damaging effects from detrimentally affecting the operation of that S&A device.

In another embodiment, the parameters of spring 120 can be selected so that the spring is relatively soft along the transverse axis and relatively stiff along the longitudinal axis. That is, to straighten the beam by a prescribed amount, a smaller amount of force will be required in the transverse direction at the center point of spring 120 than that in the longitudinal direction at the spring end attached to shuttle 110. This property is useful for the operation of latching mechanism 130 because the relatively small spring force acting in the transverse direction enables the latching mechanism to latch smoothly and reliably (see also FIG. 1B).

Contact pad 116 is electrically isolated from frame 150 by a trench 118. Thus, in the initial state shown in FIG. 1A, an electrical path consisting of frame 150, springs 148*a-d* and 120*a-b*, shuttle 110, contact springs 112*a-b*, and pad 116 has a break represented by the gap between the contact springs and the pad. After contact springs 112*a-b* have made contact with pad 116, the break is closed and the above-specified electrical path becomes continuous. Thus, S&A device 100 can act as an electrical switch responsive to acceleration. More specifically, frame 150 and contact pad 116 can act as the switch terminals. Springs 148*a-d* and 120*a-b*, shuttle 110, and contact springs 112*a-b* form a switch-terminal bridging structure that controls the state of the switch. As already indicated above, the switch is open in the initial state. At accelerations greater than $a_{contact}$, the switch is closed because contact springs 112*a-b* bridge the gap between shuttle 110 and pad 116.

Referring to FIG. 1B, latching mechanism 130 has two aligned arrow-like structures 131*a-b*, each having a respective arrowhead 132 and a respective shaft 134. Each shaft 134 is attached to the respective one of bowed springs 120*a-b* near a center point of the spring. In FIG. 1B, latching mechanism 130 is shown in the initial (unlatched) state.

As bowed springs 120*a-b* are being straightened by the inertial force, shafts 134*a-b* are pushing arrowheads 132*a-b* closer to one another until, at acceleration $a_{contact}$, surfaces 136*a-b* of the arrowheads make contact. Further straightening of bowed springs 120*a-b* by the inertial force causes surfaces 136*a-b* to begin to slide with respect to each other and slightly bend shafts 134*a-b*. When the acceleration reaches the value of $a_{latch}$, the back edges of surfaces 136*a-b* go past each other and allow the spring force generated by the bending of shafts 134*a-b* to straighten the shafts, thereby overlapping back facets 138*a-b* of arrowheads 132*a-b*, respectively, and interlocking the arrowheads. At this point, latching mechanism 130 has transitioned into the latched state.

After latching mechanism 130 has latched, removal of the inertial force can no longer return latching mechanism 130 into the initial (unlatched) state. More specifically, bowed springs 120*a-b* pull arrowheads 132*a-b* in the respective opposite directions that are orthogonal to facets 138*a-b*, and there is substantially no force component that would cause facets 138*a-b* to slide with respect to each other to remove the overlap between them. As a result, arrowheads 132*a-b* remain interlocked, and latching mechanism 130 stays in the latched state after the acceleration falls below $a_{latch}$.

Figure 2:
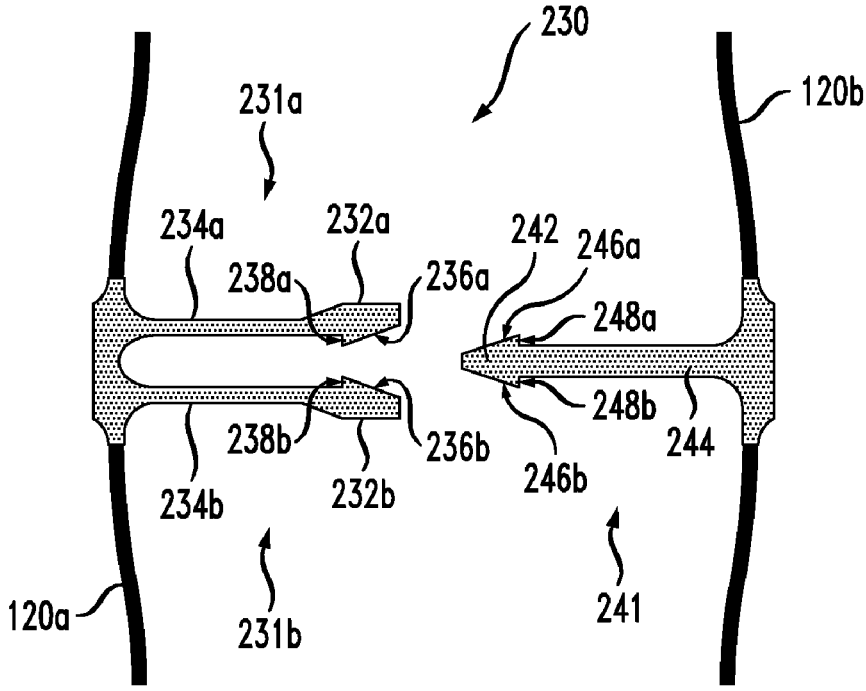
FIG. 2 shows a latching mechanism that can be used in the S&A device of FIG. 1 according to one embodiment of the invention.

FIG. 2 shows a latching mechanism 230 that can be used in place of latching mechanism 130 according to another embodiment of the invention. Latching mechanism 230 is generally analogous to latching mechanism 130, and the analogous elements of the two latching mechanisms are designated with labels having the same last two digits. However, one difference between latching mechanisms 130 and 230 is that, in the latter, arrow-like structures 231*a-b* are both attached to the same spring, i.e., spring 120*a*. Latching mechanism 230 further includes an arrow-like structure 241 that is attached to spring 120*b*. Structure 241 differs from structure 231 in that an arrowhead 242 of structure 241 has two sliding surfaces 246*a-b* and two back facets 248*a-b*. Surfaces 246*a-b* of arrowhead 242 are adapted to slide with respect to surfaces 236*a-b*, respectively, of arrowheads 232*a-b* when the inertial force brings arrow-like structure 241 into contact with arrow-like structures 231*a-b*. In the latched state of latching mechanism 230, back facets 248*a-b* overlap with back facets 238*a-b*, respectively.

Figure 3:
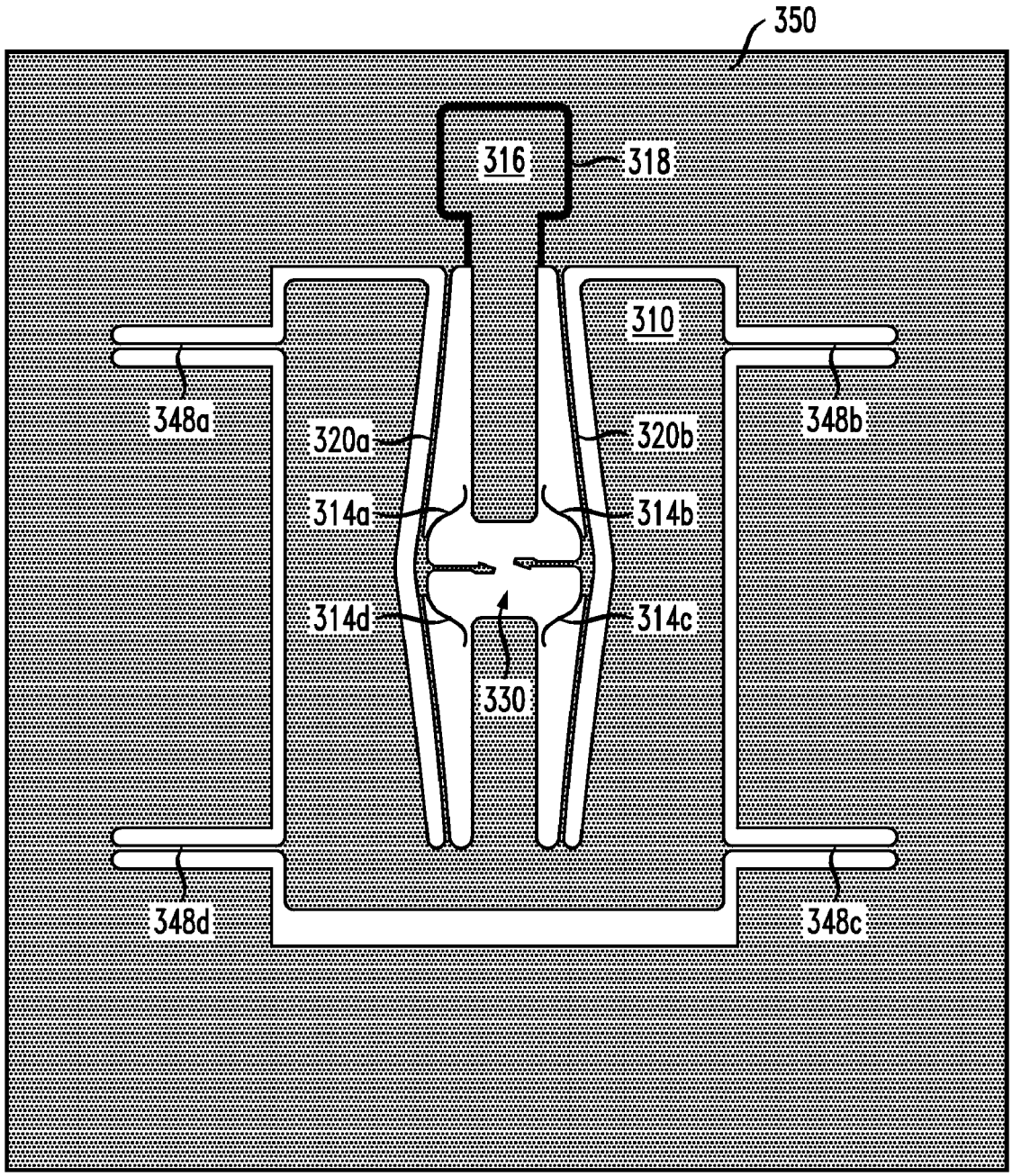
FIG. 3 shows a top view of an S&A device according to another embodiment of the invention.

FIG. 3 shows a top view of an S&A device 300 according to another embodiment of the invention. S&A device 300 is generally analogous to S&A device 100 (see FIG. 1), and the analogous elements of the two devices are designated with labels having the same last two digits. One difference between S&A devices 100 and 300 is that the latter device has four contact springs 314*a-d* that are attached to bowed springs 320*a-b*. More specifically, contact springs 314*a,d* are attached to bowed spring 320*a*, and contact springs 314*b-c* are attached to bowed spring 320*b*. Contact pad 316 of S&A device 300 has a finger that extends into the opening in shuttle 310. Shuttle 310 has a similar (middle) finger. When the acceleration reaches $a_{contact}$, the inertial force straightens springs 320*a-b* by an amount that permits contact of springs 314*a-d* with the respective fingers of shuttle 310 and pad 316.

Contact pad 316 is electrically isolated from frame 350 by trench 318. In the initial state shown in FIG. 3, an electrical path consisting of frame 350, springs 348*a-d* and 320*a-b*, shuttle 310, contact springs 314*a-d*, and pad 316 has a break represented by the respective gaps between contact springs 314*a-b* and the finger of the pad. After contact springs 314*a-b* have made contact with the finger of pad 316, the break is closed and the above-specified electrical path becomes continuous. Thus, similar to S&A device 100, S&A device 300 can act as an electrical switch responsive to acceleration.

Figure 4:
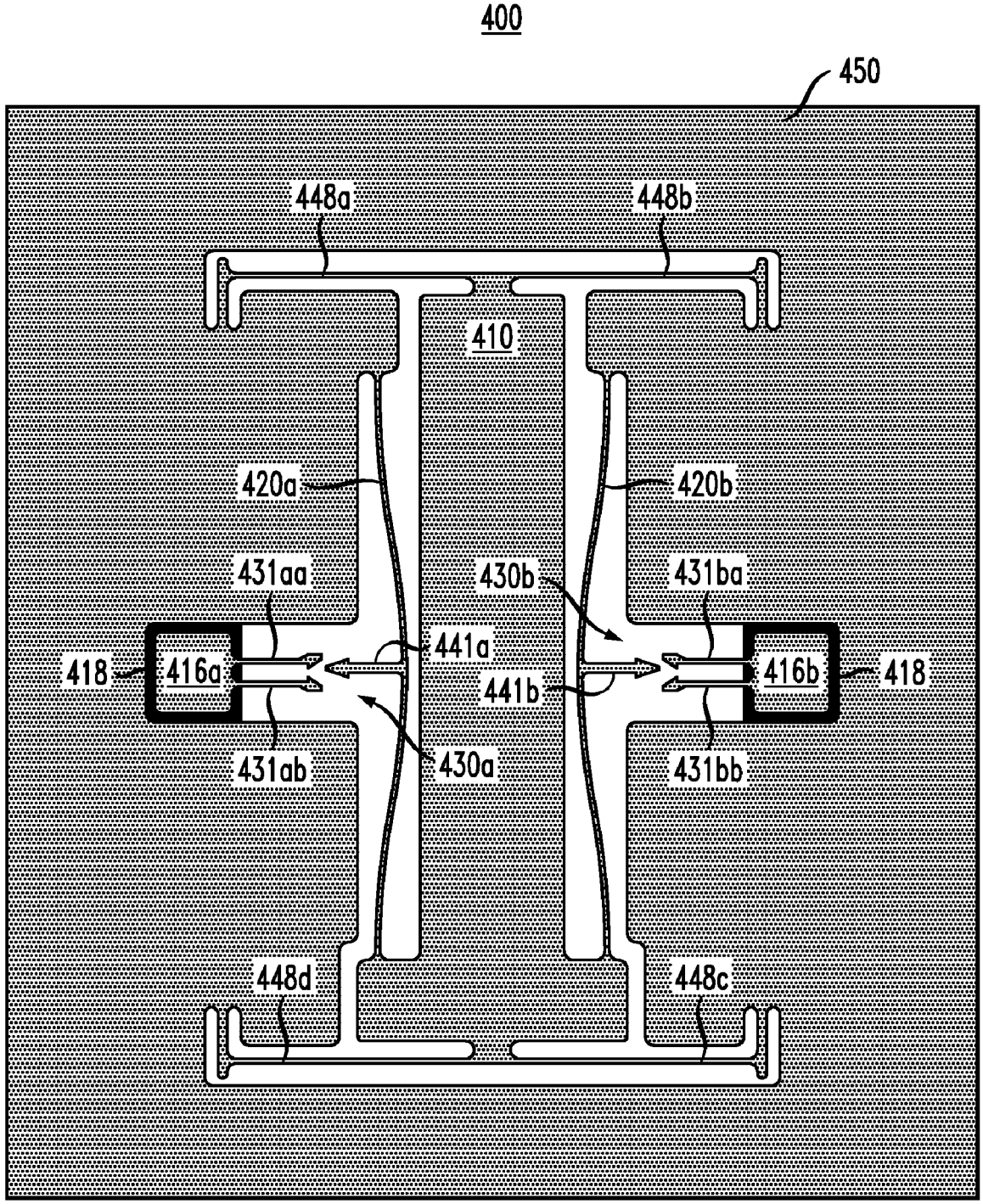
FIG. 4 shows a top view of an S&A device according to yet another embodiment of the invention.

FIG. 4 shows a top view of an S&A device 400 according to yet another embodiment of the invention. S&A device 400 is generally analogous to S&A device 300 (see FIG. 3), and the analogous elements of the two devices are designated with labels having the same last two digits. One difference between S&A devices 300 and 400 is that, in the latter device, two latching mechanisms 430*a-b*, in addition to their latching functions, also provide, in the latched state, electrical connections between frame 450 and contact pads 416*a-b*, respectively. S&A device 400 does not have contact springs that would be similar to contact springs 314*a-b* of S&A device 300.

Each of latching mechanisms 430*a-b* is similar to latching mechanism 230 (see FIG. 2). More specifically, latching mechanism 430*a* has arrow-like structures 431*aa-ab* and 441*a* that are similar to arrow-like structures 231*a-b* and 241, respectively, of latching mechanism 230. However, unlike arrow-like structures 231*a-b* in latching mechanism 230, arrow-like structures 431*aa-ab* in latching mechanism 430 are attached to pad 416*a*. Similarly, latching mechanism 430*b* has arrow-like structures 431*ba-bb* that are attached to pad 416*b*. When the acceleration reaches $a_{contact}$, the inertial force straightens springs 420*a-b* by an amount that permits initial contact between arrow-like structures 431*aa-ab* and 441*a* to the left of shuttle 410, and between arrow-like structures 431*ba-bb* and 441*b* to the right of the shuttle. When the acceleration reaches $a_{latch}$, the respective arrow-like structures of both latching mechanisms 430*a-b* interlock, as described above in reference to FIGS. 1B and 2.

Each of pads 416*a-b* is electrically isolated from frame 450 by the respective trench 418. In the initial state shown in FIG. 4, an electrical path consisting of frame 450, springs 448*a-d* and 420*a-b*, shuttle 410, latching mechanism 430*a*, and pad

416*a* has a break represented by the gap between arrow-like structures 431*aa-ab* and 441*a*. After arrow-like structures 431*aa-ab* and 441*a* have made contact with each other at acceleration $a_{contact}$, the break is closed and the above-specified electrical path becomes continuous. Thus, similar to each of S&A devices 100 and 300, S&A device 400 can act as an electrical switch responsive to acceleration.

In addition to the above-described (first) electrical path, S&A device 400 also has a second electrical path consisting of frame 450, springs 448*a-d* and 420*a-b*, shuttle 410, latching mechanism 430*b*, and pad 416*b*. Similar to the first electrical path, the second electrical path becomes continuous at acceleration $a_{contact}$. The switching capability of the second electrical path can advantageously be used, e.g., to provide redundancy and/or control an additional fire train.

Figure 5:
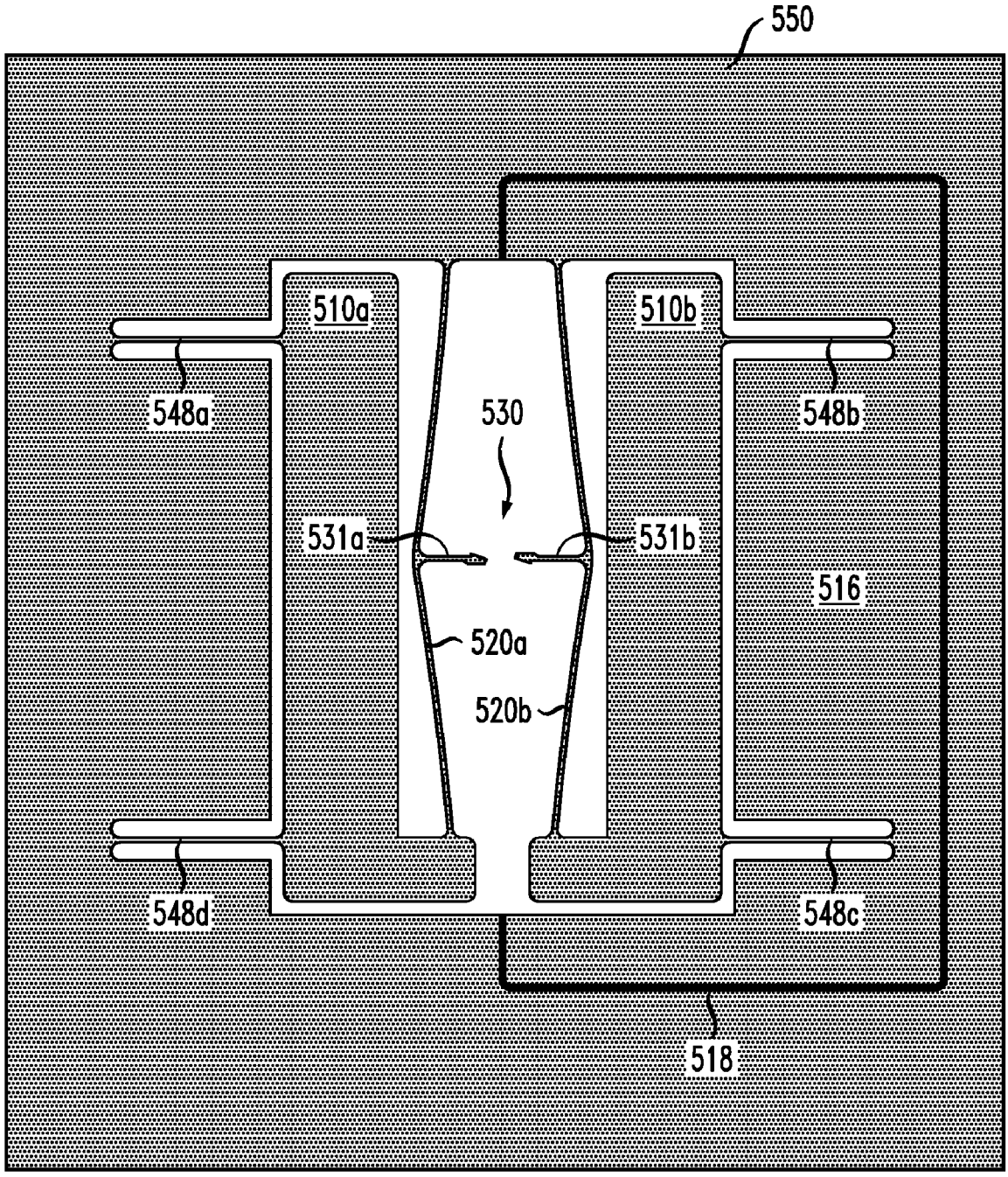
FIG. 5 shows a top view of an S&A device according to yet another embodiment of the invention.

FIG. 5 shows a top view of an S&A device 500 according to yet another embodiment of the invention. S&A device 500 is generally analogous to S&A device 400 (see FIG. 4), and the analogous elements of the two devices are designated with labels having the same last two digits. One difference between S&A devices 400 and 500 is that the latter device has two shuttles 510*a-b*. Shuttle 510*a* is movably connected to frame 550 by springs 548*a,d* and 520*a*. Shuttle 510*b* is movably connected to pad 516 by springs 548*b-c* and 520*b*. Similar to latching mechanism 430 of S&A device 400, latching mechanism 530 of S&A device 500 provides both the latching capability and electrical connection between the frame and the contact pad.

Contact pad 516 is electrically isolated from frame 550 by trench 518. Since shuttle 510*b* is attached to pad 516, the shuttle is also electrically isolated from frame 550. In the initial state shown in FIG. 5, an electrical path consisting of frame 550, springs 548*a,d* and 520*a*, shuttle 510*a*, latching mechanism 530, springs 548*b-c* and 520*a*, shuttle 510*b* and pad 516 has a break represented by the gap between arrow-like structures 531*a-b*. After arrow-like structures 531*a-b* have made contact with each other at acceleration $a_{contact}$, the gap is bridged and the above-specified electrical path becomes continuous. Thus, similar to each of S&A devices 100, 300, and 400, S&A device 500 can act as an electrical switch responsive to acceleration.

S&A devices of the invention can be fabricated as known in the art using, e.g., silicon-on-insulator (SOI) wafers. More specifically, the frame, shuttle, springs, latching mechanism(s), and contact pad(s) of an S&A device can be formed using a single (e.g., top silicon) layer of the corresponding SOI wafer. Suitable fabrication techniques are disclosed, e.g., in commonly owned U.S. Pat. Nos. 6,850,354 and 6,924,581, the teachings of which are incorporated herein by reference. Additional layers of material may be deposited onto a wafer using, e.g., chemical vapor deposition. Various parts of the devices may be mapped onto the corresponding layers using lithography. Additional description of various fabrication steps may be found, e.g., in U.S. Pat. Nos. 6,201,631, 5,629,790, and 5,501,893, the teachings of all of which are incorporated herein by reference. Representative fabrication-process flows can be found, e.g., in U.S. Pat. Nos. 6,667,823, 6,876,484, 6,980,339, 6,995,895, and 7,099,063 and U.S. patent application Ser. No. 11/095,071 (filed on Mar. 31, 2005), the teachings of all of which are incorporated herein by reference.

One skilled in the art will understand that S&A devices of the invention can respond to both acceleration and deceleration. For example, if S&A device 100 transitions into a latched state at a certain level of acceleration in the positive Y direction, then it will also transition into the latched state at the equal level of deceleration in the negative Y direction. By having multiple, appropriately oriented instances of S&A device 100, a corresponding artillery shell or projectile can be made responsive to both acceleration and deceleration events.

While this invention has been described with reference to illustrative embodiments, this description is not intended to be construed in a limiting sense. Various surfaces may be modified, e.g., by metal deposition for enhanced electrical conductivity, or by ion implantation for enhanced mechanical strength. Differently shaped shuttles, springs, beams, latches, and/or pads may be implemented without departing from the scope and principle of the invention. Various modifications of the described embodiments, as well as other embodiments of the invention, which are apparent to persons skilled in the art to which the invention pertains are deemed to lie within the principle and scope of the invention as expressed in the following claims.

It should be understood that the steps of the exemplary methods set forth herein are not necessarily required to be performed in the order described, and the order of the steps of such methods should be understood to be merely exemplary Likewise, additional steps may be included in such methods, and certain steps may be omitted or combined, in methods consistent with various embodiments of the present invention.

Reference herein to "one embodiment" or "an embodiment" means that a particular feature, structure, or characteristic described in connection with the embodiment can be included in at least one embodiment. The appearances of the phrase "in one embodiment" in various places in the specification are not necessarily all referring to the same embodiment, nor are separate or alternative embodiments necessarily mutually exclusive of other embodiments. The same applies to the term "implementation."

Throughout the detailed description, the drawings, which are not to scale, are illustrative only and are used in order to explain, rather than limit the invention. The use of terms such as height, length, width, left, right, top, bottom is strictly to facilitate the description of the invention and is not intended to limit the invention to a specific orientation.

For the purposes of this specification, a MEMS device is a device having two or more parts adapted to move relative to one another, where the motion is based on any suitable interaction or combination of interactions, such as mechanical, thermal, electrical, magnetic, optical, and/or chemical interactions. MEMS devices are fabricated using micro- or smaller fabrication techniques (including nano-fabrication techniques) that may include, but are not necessarily limited to: (1) self-assembly techniques employing, e.g., self-assembling monolayers, chemical coatings having high affinity to a desired chemical substance, and production and saturation of dangling chemical bonds and (2) wafer/material processing techniques employing, e.g., lithography, chemical vapor deposition, patterning and selective etching of materials, and treating, shaping, plating, and texturing of surfaces. The scale/size of certain elements in a MEMS device may be such as to permit manifestation of quantum effects. Examples of MEMS devices include, without limitation, NEMS (nano-electromechanical systems) devices, MOEMS (micro-opto-electromechanical systems) devices, micromachines, microsystems, and devices produced using microsystems technology or microsystems integration.

Although the present invention has been described in the context of implementation as MEMS devices, the present invention can in theory be implemented at any scale, including scales larger than micro-scale.

Also for purposes of this description, the terms "connect," "connecting," or "connected" refer to any manner known in the art or later developed in which a particular type of energy (e.g., electrical or mechanical) is allowed to be transferred between two or more elements, and the interposition of one or more additional elements is contemplated, although not required. Conversely, the term "directly connected," etc., imply the absence of such additional elements.

What is claimed is:

1. A device, comprising:

a frame;

a contact pad mechanically attached to the frame; and a first shuttle movably connected to the frame by one or more springs, wherein:

the one or more springs include a first bowed spring;

the first shuttle is adapted to move with respect to the frame in response to an inertial force;

the device is adapted to electrically connect the frame and the contact pad;

if a projection of the inertial force onto a designated axis is smaller than a first threshold value, then the frame and the contact pad are not electrically connected;

if said projection reaches or exceeds the first threshold value, then displacement of the first shuttle produced by the inertial force causes the contact pad to be electrically connected to the frame;

the first bowed spring comprises a beam whose shape, in an initial state, deviates from a straight shape;

the beam has (i) an end attached to the first shuttle and (ii) a midpoint; and in response to the inertial force, the beam is adapted to deform so that a transverse displacement of the midpoint relative to the frame is larger than a corresponding displacement of the end relative to the frame along the designated axis.

2. The invention of claim 1, wherein the beam is oriented so that said projection tends to straighten the beam.

3. The invention of claim 1, wherein:

to make the beam straighter by a prescribed amount, a smaller amount of force is required in a transverse direction at the midpoint than in a longitudinal direction at the end.

4. The invention of claim 1, wherein, in the initial state, the beam has a shape substantially described by the following equation:

$$x = \frac{x_{mp0}}{2}[1 + \cos(2\pi y/l)],$$

where y is a coordinate along a longitudinal axis of the beam; x is a coordinate along a transverse axis that passes through a center point of the beam; l is a distance between opposite ends of the beam; and $x_{mp0}$ is an x coordinate of the center point.

5. The invention of claim 1, wherein the first bowed spring is a nonlinear spring.

6. The invention of claim 5, wherein:

as said projection increases, displacement of said end relative to the frame along the designated axis tends toward a limiting value.

7. The invention of claim 1, further comprising a latching mechanism, wherein:

if said projection reaches or exceeds a second threshold value greater than the first threshold value, then the latching mechanism latches to keep the frame electrically connected to the contact pad thereafter.

8. The invention of claim 7, wherein:

if said projection reaches or exceeds the first threshold value, then the displacement of the first shuttle relative to the frame causes the latching mechanism to bridge an electrical break between the frame and the contact pad.

9. The invention of claim 7, wherein:

the one or more springs include a second bowed spring;

the latching mechanism comprises:

a first arrow-like structure attached to the first bowed spring; and a second arrow-like structure attached to the second bowed spring; and the first and second arrow-like structures are adapted to interlock if said projection reaches or exceeds the second threshold value.

10. The invention of claim 9, wherein:

the latching mechanism comprises a third arrow-like structure attached to the first bowed spring in proximity to the first arrow-like structure; and the second and third arrow-like structures are adapted to interlock if said projection reaches or exceeds the second threshold value.

11. The invention of claim 7, wherein:

the latching mechanism comprises:

a first arrow-like structure attached to the first bowed spring; and a second arrow-like structure attached to the contact pad; and the first and second arrow-like structures are adapted to interlock if said projection reaches or exceeds the second threshold value.

12. The invention of claim 11, wherein:

the latching mechanism comprises a third arrow-like structure attached to the contact pad in proximity to the first arrow-like structure; and the second and third arrow-like structures are adapted to interlock if said projection reaches or exceeds the second threshold value.

13. The invention of claim 1, further comprising one or more contact springs, wherein:

if said projection reaches or exceeds the first threshold value, then the displacement of the first shuttle relative to the frame causes at least one of said contact springs to bridge an electrical break between the frame and the contact pad.

14. The invention of claim 1, further comprising:

a second shuttle movably connected to the contact pad by respective one or more springs; and a latching mechanism that comprises:

a first arrow-like structure attached to the first bowed spring; and a second arrow-like structure attached to a second bowed spring, wherein:

said respective one or more springs include the second bowed spring; and if said projection reaches or exceeds the first threshold value, then respective displacements of the first and second shuttles cause the first and second arrow-like structures to contact each other and bridge an electrical break between the frame and the contact pad.

15. The invention of claim 14, wherein:

the first and second arrow-like structures are adapted to interlock if said projection reaches or exceeds a second threshold value greater than the first threshold value.

16. The invention of claim 1, wherein the frame, the contact pad, the first shuttle, and the one or more springs are formed in a common layer of a multilayered wafer.

17. The invention of claim 1, further comprising:

an explosive charge, wherein the closing of the electrical break enables detonation of said explosive charge.

18. The invention of claim 17, wherein:

the device is adapted to be launched through a gun barrel having a center axis; and the designated axis is parallel to the center axis.

19. A device, comprising:

a frame;

a contact pad mechanically attached to the frame; and a first shuttle movably connected to the frame by one or more springs, wherein:

the one or more springs include a first bowed spring;

the first shuttle is adapted to move with respect to the frame in response to an inertial force;

the device is adapted to electrically connect the frame and the contact pad;

if a projection of the inertial force onto a designated axis is smaller than a first threshold value, then the frame and the contact pad are not electrically connected;

if said projection reaches or exceeds the first threshold value, then displacement of the first shuttle produced by the inertial force causes the contact pad to be electrically connected to the frame;

the first bowed spring comprises a beam whose shape, in an initial state, deviates from a straight shape;

the beam has (i) an end attached to the first shuttle and (ii) a midpoint; and to make the beam straighter by a prescribed amount, a smaller amount of force is required in a transverse direction at the midpoint than in a longitudinal direction at the end.

20. A device, comprising:

a frame;

a latching mechanism;

a contact pad mechanically attached to the frame; and a first shuttle movably connected to the frame by one or more springs, wherein:

the one or more springs include a first bowed spring;

the first shuttle is adapted to move with respect to the frame in response to an inertial force;

the device is adapted to electrically connect the frame and the contact pad;

if a projection of the inertial force onto a designated axis is smaller than a first threshold value, then the frame and the contact pad are not electrically connected;

if said projection reaches or exceeds the first threshold value, then displacement of the first shuttle produced by the inertial force causes the contact pad to be electrically connected to the frame;

if said projection reaches or exceeds a second threshold value greater than the first threshold value, then the latching mechanism latches to keep the frame electrically connected to the contact pad thereafter;

the latching mechanism comprises:

a first arrow-like structure attached to the first bowed spring; and a second arrow-like structure attached to the contact pad; and the first and second arrow-like structures are adapted to interlock if said projection reaches or exceeds the second threshold value.

21. The invention of claim 20, wherein:

the latching mechanism comprises a third arrow-like structure attached to the contact pad in proximity to the first arrow-like structure; and the second and third arrow-like structures are adapted to interlock if said projection reaches or exceeds the second threshold value.

* * * * *